US005624109A

United States Patent [19]

Tanaka

[11] Patent Number: 5,624,109

[45] Date of Patent: Apr. 29, 1997

[54] SHEET FEEDING APPARATUS WITH ROTARY POWER TRANSMISSION MECHANISM

[75] Inventor: Makoto Tanaka, Nagaokakyo, Japan

[73] Assignee: Murata Kikai Kabushinki Kaisha, Kyoto, Japan

[21] Appl. No.: 351,802

[22] Filed: Dec. 8, 1994

[30] Foreign Application Priority Data

Dec. 9, 1993 [JP] Japan ..... 5-309115

[51] Int. Cl.[6] ..... B65H 5/00; B65H 3/06

[52] U.S. Cl. ..... 271/10.13; 271/118; 271/122

[58] Field of Search ..... 271/10.04, 10.11, 271/10.13, 117, 118, 121–122

[56] References Cited

U.S. PATENT DOCUMENTS

| | | | |
|---|---|---|---|
| 4,934,686 | 6/1990 | Ono et al. | 271/118 X |
| 5,085,420 | 2/1992 | Sata | 271/118 X |
| 5,423,526 | 6/1995 | Hasegawa | 271/118 X |

FOREIGN PATENT DOCUMENTS

| | | | |
|---|---|---|---|
| 24684 | 2/1993 | Japan | 271/118 |
| 301645 | 11/1993 | Japan | 271/118 |
| 16259 | 1/1994 | Japan | 271/118 |
| 72581 | 3/1994 | Japan | 271/118 |

*Primary Examiner*—Boris Milef

*Attorney, Agent, or Firm*—Loeb & Loeb LLP

[57] ABSTRACT

A sheet feeding mechanism has a pick up roller which picks up one sheet from a pile on a tray and sends It to contact between a separation roller and a retardation roller. A shaft which positively rotates in a sheet feeding direction is provided with a first gear and the separation roller via an arm pivotable about the shaft and a spring clutch. The arm carries a second gear which receives rotary power from the first gear, a third gear engaged with the second gear and the pick up roller connected with the third gear. The arm is biased upwardly and a negative torque is applied to the second or third gear. Below the separation roller, provided is the retardation roller which is mounted on another shaft via a torque limiter and pressed against the separation roller. The another shaft rotates in a direction opposite the sheet feeding direction. Up and down movement of the pick up roller is mechanically controlled.

4 Claims, 16 Drawing Sheets

SHEET FEEDING APPARATUS WITH ROTARY POWER TRANSMISSION MECHANISM

BACKGROUND AND SUMMARY OF THE INVENTION

The present invention relates to a sheet feeding apparatus used for a facsimile machine or a copy machine.

Facsimile machines and photocopiers generally have a sheet feeding unit to transfer sheets to a reading device incorporated in the facsimile machines and photocopiers so that the reading device can read an image on a sheet and convert it to an electric signal (i.e., image data). In order to perform a smooth reading operation to a large number of sheets, the sheets are usually plied up on a tray, and upon pressing of a read key, a roller unit of the facsimile machine or a copier contacts the pile of sheets and starts rotating to pick up the sheets one piece by one piece thereby transmitting them to the reading unit.

Generally, the reading unit has an upwardly directed reading unit to optically read the sheet. Therefore, the sheet should be fed to the reading unit with its upside down. Conventionally, the sheets are stacked on the tray with their upside down so that the sheets are taken from the bottom.

If the sheets are stacked on the tray with their upside up, a sheet feeding device picks up the sheets from the top of the pile on the tray. In this case, the sheets are turned upside down before they enter the reading unit. The facsimile machine or copier may have a U-turn passage or mechanism for this operation.

If the sheet feeding device has such a sheet turning mechanism, generally a sheet tray on a feeding side (referred to as "sheet feeding tray") is located above another sheet tray on a receiving side or a discharge side (referred to as "sheet receiving tray"). Therefore, the space required for these trays is small as compared with an arrangement in which the trays are situated in a coplanar manner. Further, since the sheets are piled on the sheet feeding tray with their upside up, an operator can see what is written on the sheet. This prevents errors in a copying operation and a sheet transmission. In addition, it is insured that a roller unit which picks up the sheets one piece by one piece functions properly regardless of the height (or weight) of the sheet pile on the sheet feeding tray. This is because the sheets are taken from the top of the pile. Specifically, if the sheet feed device takes the sheets from the bottom of the sheet pile, the roller unit may not function appropriately due to a large load exerted by the sheet pile.

The sheet feeding device which transmits the sheets from the bottom of the pile employs a separation roller unit and a separation pad to send the sheets piece by piece at one time. On the other hand, the sheet feeding device which transmits the sheets from the top of the pile generally has an arrangement for isolating one sheet from the sheet pile at each feeding operation as illustrated in FIG. 21 of the accompanying drawings. As shown in this drawing, the sheet pick up arrangement includes an isolation or separation roller Sr provided on a shaft A1 which positively rotates clockwise or in a sheet feeding direction, a retardation roller Rr provided on another shaft A2, which is located under the shaft A1 and positively rotates clockwise or in a direction opposite the sheet feeding direction, to contact the separation roller Sr with a certain force or pressure, an Am mounted on the shaft A1 to be swingable or pivotable about the shaft A1 upon operation of a solenoid (not shown), and a pick up roller Pr mounted on a free end of the arm Am and driven by the separation roller Sr via a gear or belt mechanism or the like. A torque limiter (not shown) is sandwiched interposed between the retardation roller Rr and the shaft A2.

A coil spring or the like (not shown) is also mounted on the free end of the arm Am to bias the arm Am upward. in a normal state, accordingly, the arm Am and the pick up roller Pr are forced to a raised position such that they do not become obstacles against a sheet loading operation onto a tray tr1. Further, friction between the sheets D and the retardation roller Rr is larger than a friction between the sheets D themselves in this arrangement.

Next, a sheet pick up operation will be described.

First, the solenoid is activated to rotate the arm Am clockwise or to move the same downward so that the pick up roller Pr contacts the top piece of the sheet pile D. Then, the pick up roller Pr rotates to feed the top sheet toward the separation roller Sr and the retardation roller Rr. At this point, the torque limiter does not allow a rotary power of the shaft A2 to be transmitted to the retardation roller Rr. Therefore, the retardation roller Rr is trailingly or dependently rotated by the separation roller Sr in an counterclockwise direction, as indicated by the outer counterclockwise arrow, whereas the shaft A2 rotates in the clockwise direction as indicated by the inner arrow. As the sheet reaches contact between the separation roller Sr and the retardation roller Rr, it is further transferred to another pair of rollers r1 and r2 located downstream in the sheet feeding direction by the separation roller Sr.

When the sheet reaches the transfer rollers r1 and r2, the solenoid is turned off and the arm Am swings upward due to the biasing force of the spring so that the pick up roller Pr leaves the sheets D to complete a separate and feed operation for one sheet. As this operation is repeated, the height of the sheet pile D becomes smaller. However, the pick up roller Pr can reach the sheet pile D of a reduced height as the arm Am is swung downward more. Therefore, it is possible to pick up all the sheets on the tray tr1 and transfer them to the separation roller Sr.

If more than one sheets are transmitted to the contact between the separation roller Sr and the retardation roller Rr, the bottom one of these sheets in touch with the retardation roller Rr is fed back to the tray tr1 by the rotary power of the retardation roller Rr which rotates clockwise in such a situation. Since the friction between the sheets themselves is weaker than that between the sheet and the retardation roller Rr, slippage occurs between the sheets and the rotary power of the separation roller Sr is not transmitted to the retardation roller Rr. As a result, the torque limiter acts to transmit the rotary power of the shaft A2 to the retardation roller Rr. Accordingly, only one sheet is allowed to pass through the separation roller Sr and the retardation roller Rr.

Referring to FIG. 22 of the accompanying drawings, illustrated is a conventional scanner portion of a facsimile machine which has a U-turn mechanism. In FIG. 22, A designates a main body of a scanner, B a U-turn guide member extending in a width direction (a right-and-left direction in the drawing) and C a cover. A sheet feeding tray tr1 is inserted into in entrance opening EN formed at an upper portion of the guide member B and sheets (not shown) are fed one piece by one piece to a transfer passage "m" through a feed roller "a" on the guide member B side and a separation roller "b" on the cover C side. Then, the sheets are U-turned by a second feed roller "d" located at a downstream end of the guide member B and a belt "e" located close to the second feed roller "d" and then transferred to a second transfer passage "f" on the main body A side. Thereafter, the sheets are read by a scanner (not shown) incorporated in the main body A. After a reading operation, the sheets are transferred by another pair of opposing transfer rollers "g" and "k", one located in the main body A and the other located in the guide member B, to an exit EX formed at a lower area of the guide member B and in turn to a sheet receiving tray tr2.

According to the conventional arrangement, the rollers "a", "d", "k" and other parts mounted on the guide member B are driven by a drive source (e.g., motor) M (not shown in FIG. 22; see FIG. 23), and the motor M is generally mounted on a bracket BK extending from one end of the guide member B. The motor M is therefore swingable together with the guide member B with a point (shaft) "i" being a pivot, as indicated by the broken line in FIG. 22. Thus, the guide member B and the motor M pivots over the main body A.

However, the conventional apparatus has the following problems:

i) since a solenoid is used to move the pick up roller Pr (FIG. 21) up and down, a cost is high, an electric control is needed and a structure becomes complicated. One object of the present invention is to eliminate this drawback, i.e., to provide a mechanical arrangement which can move a pick up roller inexpensively and easily and can realize a smooth and reliable sheet separation;

ii) if the sheet should be turned upside down in a sheet feeding device (FIG. 22), a relatively long transfer passage is required prior to the reading operation. Therefore, the width of the guide member B is inevitably elongated and the guide member B draws a large arc when it is pivoted to a stable open position as indicated by the broken arrow in FIG. 22 (the guide member B should be opened when jamming occurs). Consequently, a space for the arrangement becomes large. Another object of the present invention is to overcome this problem;

iii) a sufficient vertical step cannot be formed between the exit EX and the sheet receiving tray tr2 if a scanner unit placed in the main body A has a large width extending beneath the sheet receiving tray tr2 since the scanner unit limits the location of the tray tr2. If the width of the scanner unit was small, the tray tr2 could be located at a lower position. Still another object of the present invention is to eliminate this shortcoming. If a relatively large step is formed between the exit Ex and the tray tr2, the tray tr2 can hold a relatively large amount of sheets; and iv) if the drive source M (FIG. 23) is attached to an end of the guide member B, a total width L of the sheet feeding device is enlarged. As a result, when the sheet feeding device is incorporated in a facsimile machine, a total width of the facsimile machine is also enlarged. Yet another object of the present invention is to provide a sheet feeding device which is compact having a relatively small width.

According to one aspect of the present invention, there is provided a sheet feeding arrangement which comprises a rotary shaft positively rotatable in a sheet feeding direction, a separation roller mounted on the rotary shaft, a retardation roller in contact with the separation roller with a certain force, an arm adapted to be able to move up and down relative to the rotary shaft, a pick up roller mounted on an end of the arm, and a rotary power transmission mechanism connected with the arm to transmit a rotary power of the rotary shaft to the pick up roller and to move the arm downward using the rotary power of the rotary shaft. The separation roller rotates as the rotary shaft rotates. The rotary power of the rotary shaft is transmitted to the pick up roller via the rotary power transmission mechanism. The rotary power of the rotary shaft causes the arm to move downward.

The separation roller may be provided with a one-way clutch to allow the separation roller to perform an idle rotation or a lost motion in a direction as the rotary shaft rotates (lost motion in the sheet feeding direction). If a peripheral velocity of a rotating transfer roller provided downstream of the separation roller in the sheet feeding direction is greater than a peripheral velocity of the rotating separation roller, the separation roller performs an idle rotation in the direction the rotary shaft rotates due to a friction between the sheet and the separation roller as long as the sheets are simultaneously contact the transfer roller and the separation roller. Therefore, the separation roller rotates at the same speed (peripheral speed) as the transfer roller.

The retardation roller may be connected with a drive source via a torque limiter and the drive source may drive the retardation roller in a direction opposite the sheet feeding direction (referred to as "reverse direction"). If more than one sheet are sandwiched by the separation roller and the retardation roller, the retardation roller rotates in the reverse direction. Thus, only one sheet is allowed to pass between the separation roller. If only one sheet exists between the separation roller and the retardation roller, which is an expected or desired situation, the retardation roller is disconnected from its drive source by the torque limiter while the separation roller is rotating in the sheet feeding direction. As a result, the retardation roller is driven by the separation roller and rotates in the sheet feeding direction to cooperatively work with the separation roller.

The arm may be biased upward by an elastic member. The arm moves upward due to a biasing force of the elastic member when the arm does not have to stay at a downward forced position.

The rotary power transmission mechanism may be elastically mounted on the arm and a torque generated by the elastic installation is larger than the biasing force exerted by the elastic member. Since the elastically generated torque of the rotary power transmission mechanism to the arm is greater than the biasing torque of the elastic member, the rotation of the rotary shaft causes the arm to move downward, but does not cause elements of the rotary power transmission mechanism to rotate. The rotary power is transferred to the pick up roller via the rotary power transmission mechanism upon completion of the downward movement of the arm.

A rotatable member for transmission of the rotary power to the rotary power transmission mechanism and the separation roller may be rotatable relative to the rotary shaft. A coil spring may be fixed to the rotary shaft at a one end thereof and to the separation roller at the other end and loosely fitted over the rotary shaft to form a spring clutch. As a diameter of the coil spring becomes smaller upon rotation of the rotary shaft, the coil spring and the rotatable member are tightly engaged (the coil spring clinches the rotatable member) to transmit the rotary power of the rotary shaft to the rotatable member (the rotatable member rotates and the rotary power transmission mechanism and the rotary shaft are connected with each other). If the transfer roller located downstream of the separation roller in the sheet feeding direction rotates faster than the separation roller in terms of peripheral speed, the separation roller rotates idly in the same direction as the rotary shaft due to a friction between the sheets and the separation roller as far as the sheet is forced to move by the transfer roller and the separation roller at the same time. Therefore, the separation roller rotates at the same peripheral speed as the transfer roller. This causes an idle rotation of the separation roller. As the separation roller performs the idle rotation relative to the rotary shaft, the diameter of the coil spring is enlarged since the other end of the coil spring which is fixed to the separation roller rotates and the diameter of the coil spring becomes greater and consequently the (tight) engagement between the coil spring and the rotatable member is released, whereby the rotary power of the rotary shaft is no longer transmitted the rotatable member.

According to another aspect of the present invention, there is provided a sheet feeding device of a type having a guide member pivotable about a shaft, sheets being U turned around the guide member prior to a sheet discharge operation, characterized in that a transversal section of the guide member is shaped to a configuration close to a circle, more specifically one having a semicircular lower half pivotably mounted on the shaft and a trapezoid upper half having a reduced free end. Since the guide member has a section similar to a circle, the width of the guide member can be designed relatively short (shorter than a prior art arrangement). Therefore, an arc movement of the guide member upon opening becomes smaller. It is also possible to form a sheet entrance opening and a sheet exit opening relatively closely in terms of vertical distance. This allows to form a relatively large step between the sheet exit opening and a sheet receiving tray.

A drive source for the rolls mounted on the guide member may be located inside the guide member. This reduces a whole width of the arrangement as compared with a prior art arrangement which has a drive source externally attached to the guide member.

DETAILED DESCRIPTION OF THE PREFERRED EMBODIMENTS

Now, a preferred embodiment of a sheet feeding device according to the present invention will be described with reference to the accompanying drawings.

Referring to FIGS. 1 to 4, a general structure of the sheet feeding device F will be described first.

Figure 6:
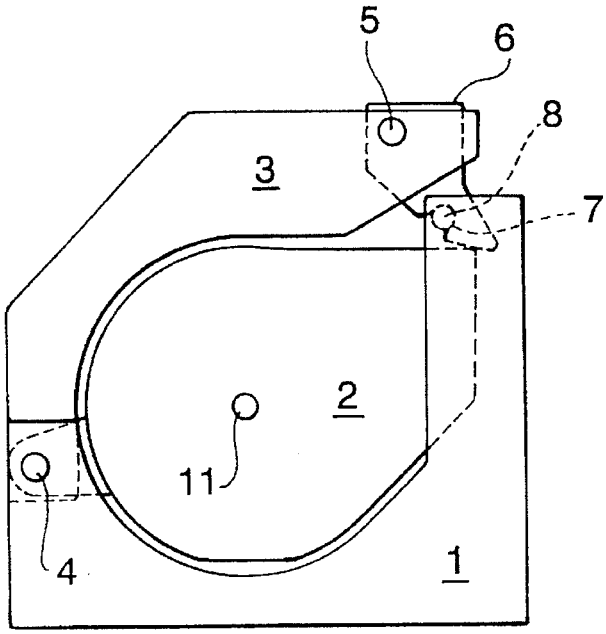
FIG. 6 is a lateral view of the sheet feeding device shown in FIG. 1.

As illustrated, the sheet feeding device F generally has a cylindrical shape and includes three major parts, i.e., a lower frame 1, a tubular sheet guide 2 and an upper frame 3. These three parts 1, 2 and 3 are pivotably provided on a mutual shaft 4 as will be described using FIGS. 6 to 8. The upper frame 3 has a U-shaped locking lever 6 which is pivotable about a shaft 5. The locking lever 6 is biased clockwise by a torsion spring (not shown). The locking lever 6 has locking grooves 7 at ends. These grooves 7 engage with lock pins 8 fixed to the lower frame 1 so that the upper frame 3, the sheet guide 2 and the lower frame 1 are fixed to each other (FIG. 6).

Figure 11:
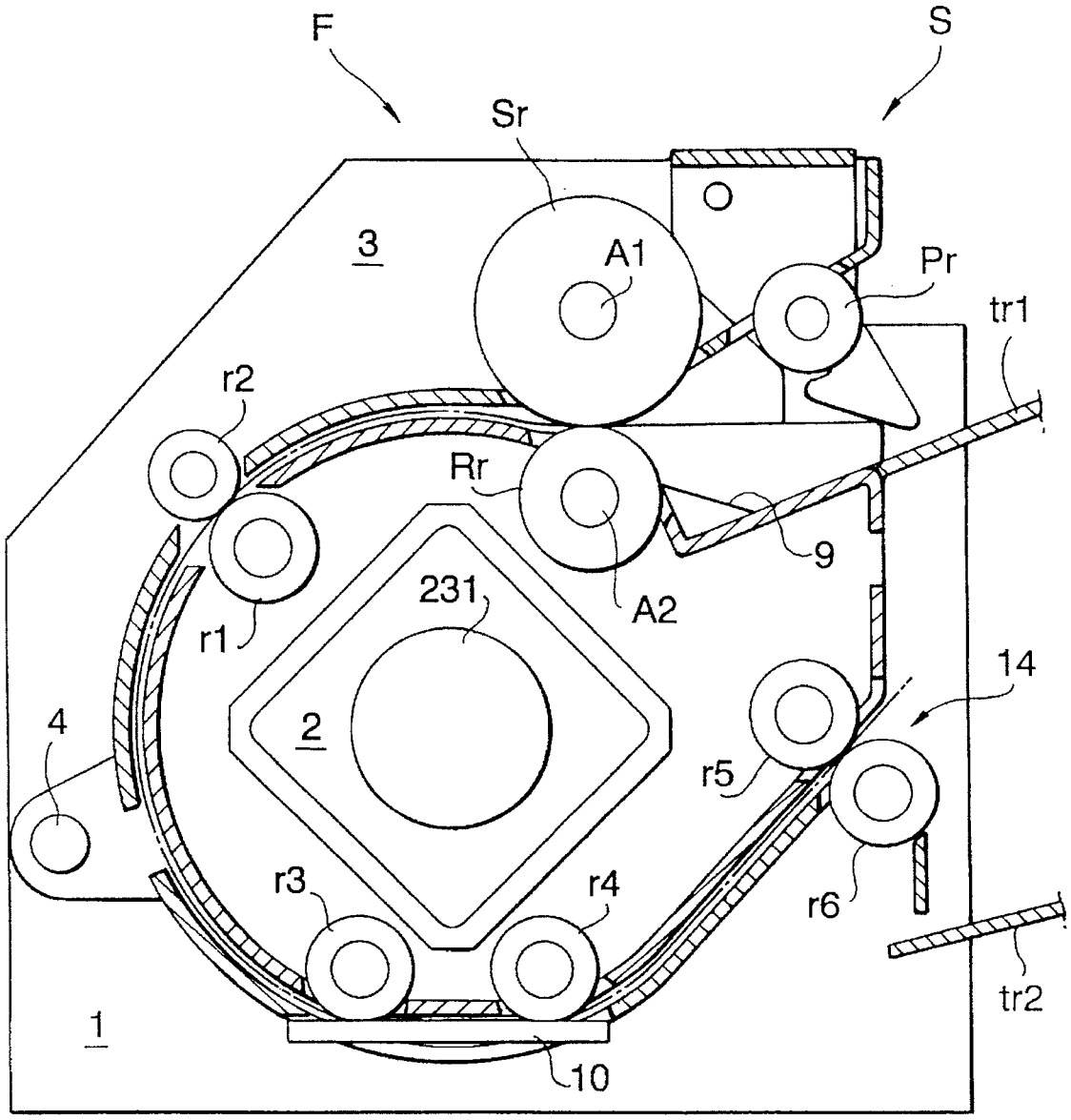
FIG. 11 is a lateral section of the sheet feeding device illustrating rollers incorporated in the sheet feeding device.

To release the locking engagement and allow a pivot movement of the upper frame 3, an operator holds a flat portion of the locking lever 6 and forces the locking lever 6 to pivot counterclockwise against the biasing force exerted by the torsion spring. Upon disengagement, the locking lever 6 is moved upward and consequently the upper frame 3 is also moved upward (or pivoted counterclockwise). The sheet guide 2 is free to pivot after disengagement of the locking lever 6. As shown in FIG. 11, a sheet passage is formed between the upper frame 3 and the sheet guide 2 and between the sheet guide 2 and the lower frame 1.

Sheets are piled on a sheet feeding tray tr1 inserted to an entrance opening formed in an upper portion of the sheet feeding device F, picked up one piece by one piece by a sheet separation unit S and introduced to the sheet passage. A plurality of transfer rollers are provided along the sheet passage and the sheets are U turned as they proceed on the sheet passage. Finally, the sheets are discharged from an exit opening 14 and received by a sheet receiving tray tr2 situated downstream of and below the exit 14. Transparent films 9 (FIG. 3) are located between the sheet feeding tray tr1 and an entrance of the sheet passage such that the sheets can smoothly advance to the sheet passage. It should be noted that the transparent film 9 may be replaced by a non-transparent element as long as it has a smooth surface.

Figure 4:
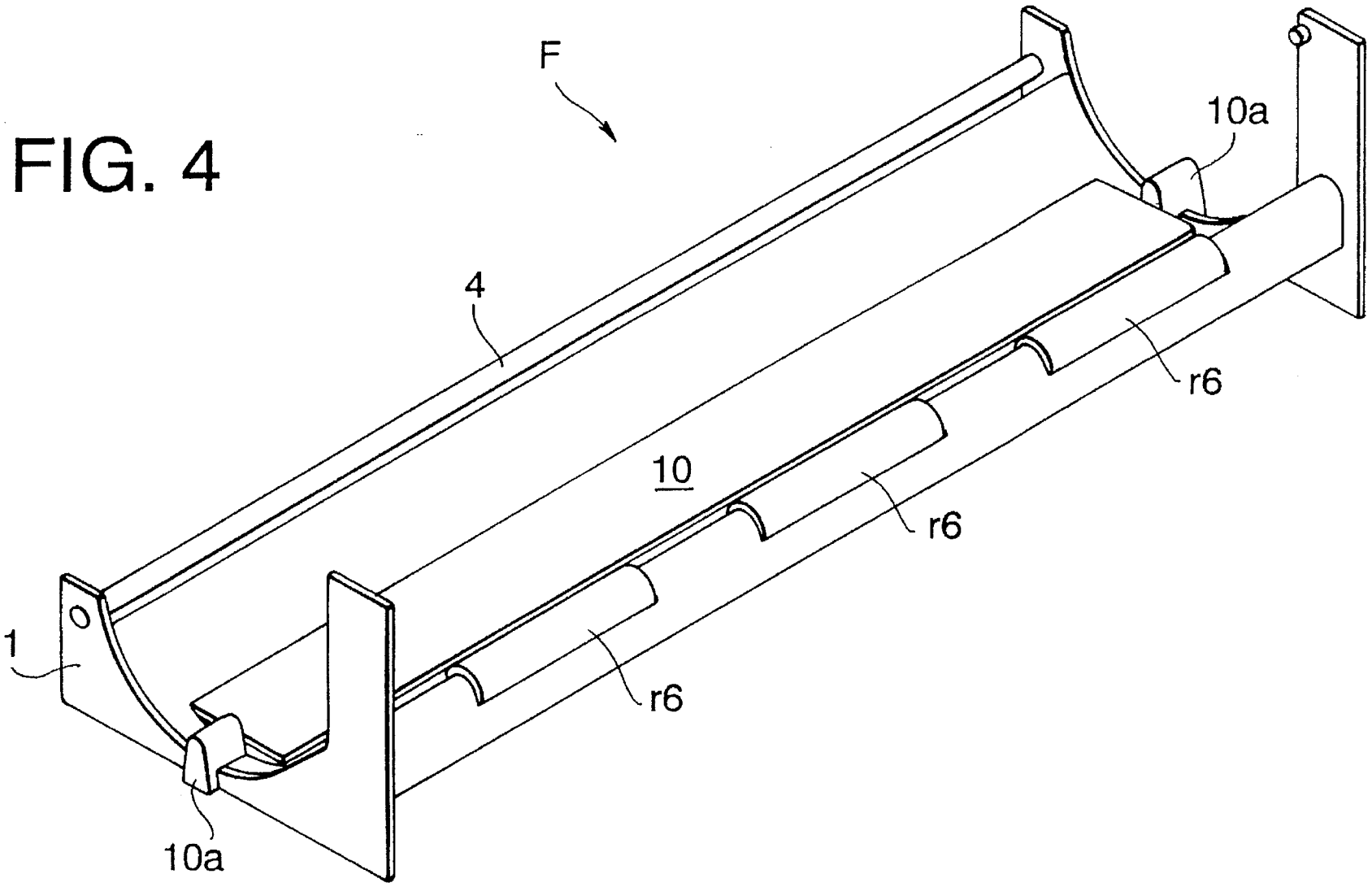
FIG. 4 shows a perspective view of the lower frame shown in FIG. 3.
Figure 5:
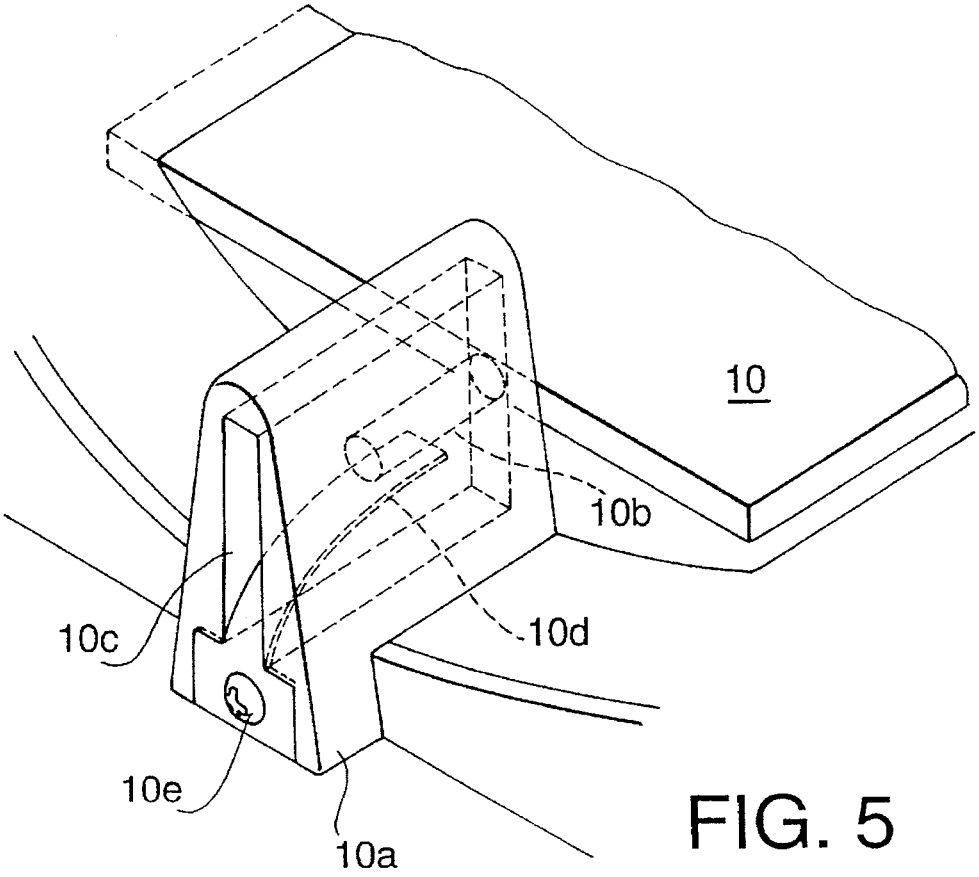
FIG. 5 is an enlarged view of a portion of the sheet feeding device shown in FIG. 1.

Referring to FIG. 4, a scanner glass 10 is provided on an approximate center of the lower frame 1 and supported by wedge-like support elements 10*a* at both ends. Below the scanner glass 10, located is a reading unit having a light source, an image sensor and other parts (all not shown). Likewise, characters, lines, drawings and the like on the sheet are read by the reading unit and converted to image data (electric signals). Referring to FIG. 5, the scanner glass 10 has protrusions 10*b* at ends (only one protrusion is illustrated), and each protrusion 10*b* fits in a bore 10*c* formed in each support element 10*a*.

Each protrusion 10*b* is biased upward by a leaf spring 10*d* fixed to the support element 10*a* by a screw 10*e*. Referring to FIG. 11, this biasing force imposes an upper surface of the scanner glass 10 to contact readings rollers r3 and r4 with a certain pressure. As a result, the scanner glass 10 is maintained in position and an appropriate reading accuracy is insured. It should be noted that the sheet feeding tray tr1 and the-sheet receiving tray tr2 are not illustrated in FIGS. 1 to 4 for the sake of clarity of other parts.

Figure 1:
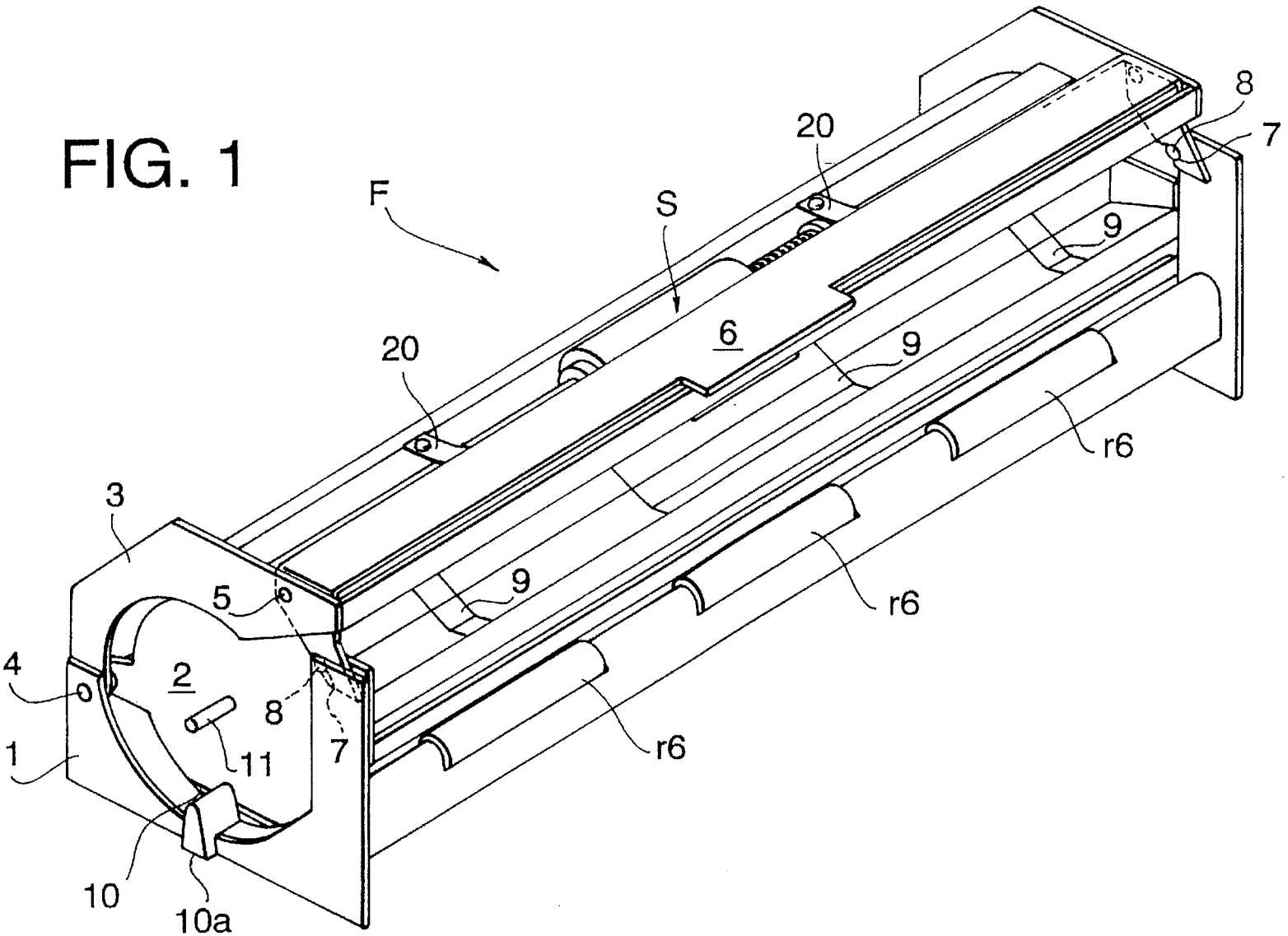
FIG. 1 is a perspective view of a sheet feeding device F according to the present invention.
Figure 2:
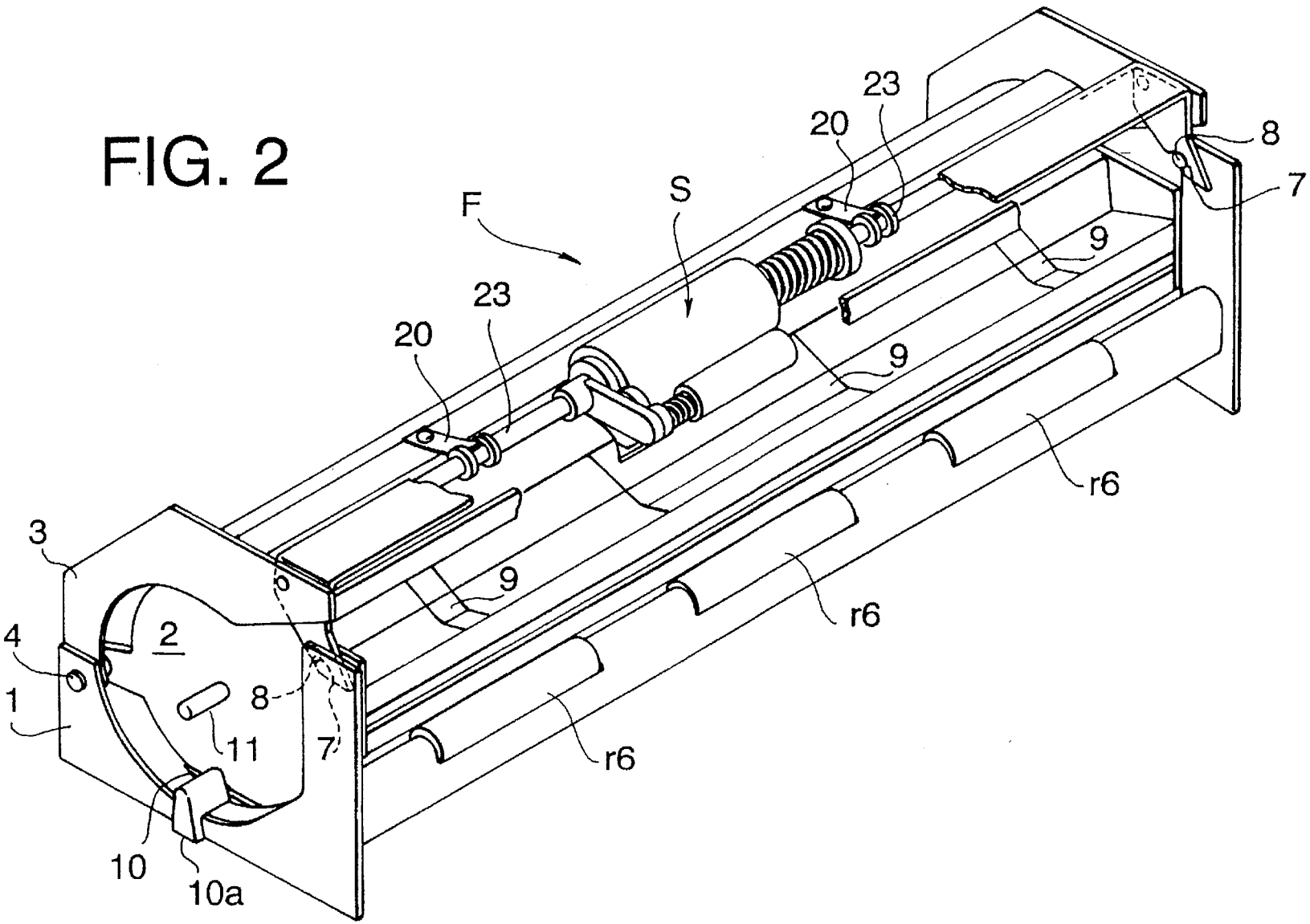
FIG. 2 illustrates a partially fragmented perspective view of the sheet feeding device shown in FIG. 1.
Figure 3:
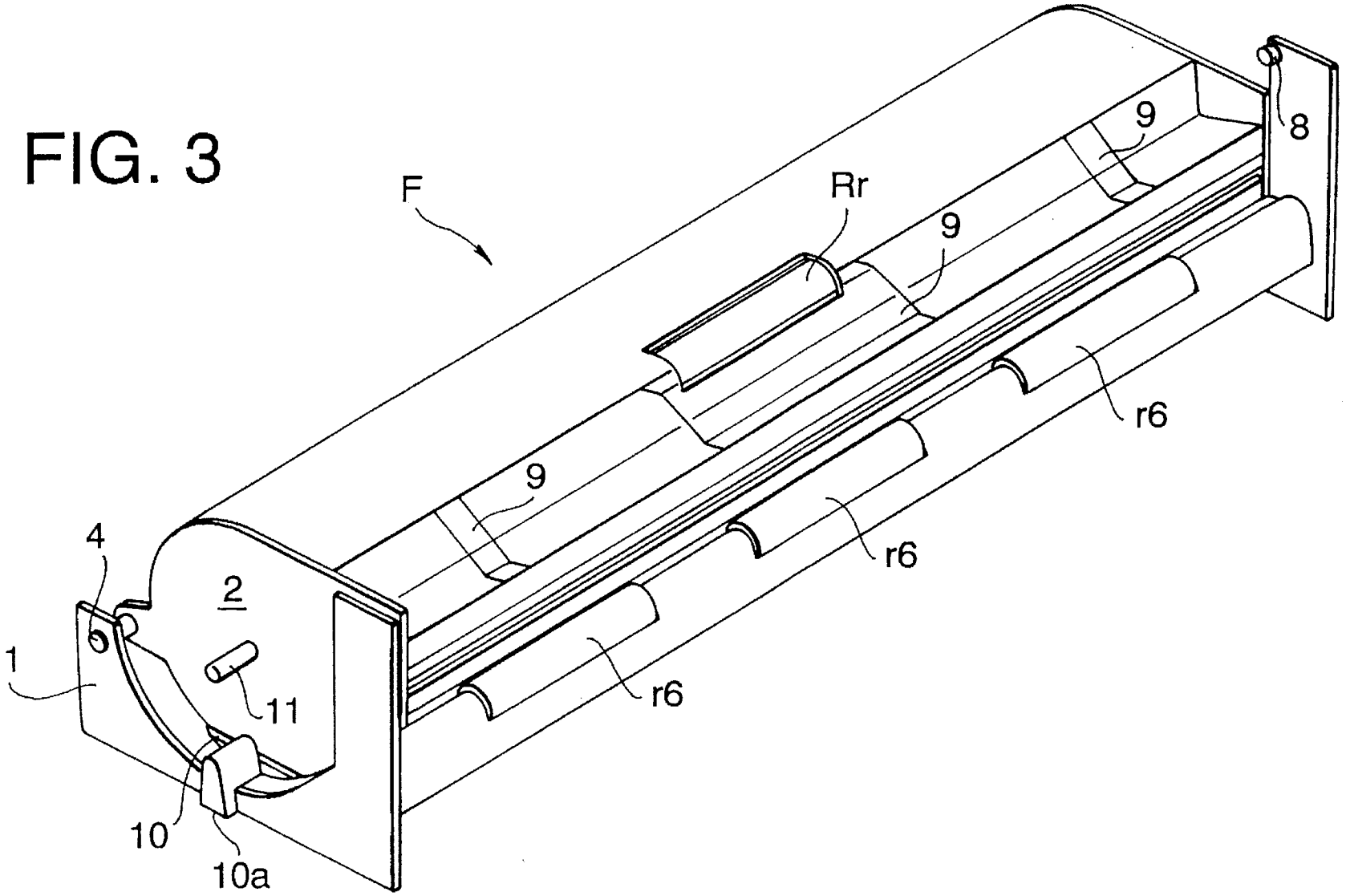
FIG. 3 mainly illustrates a sheet guide portion and a lower frame of the sheet feeding device shown in FIG. 1.
Figure 9:
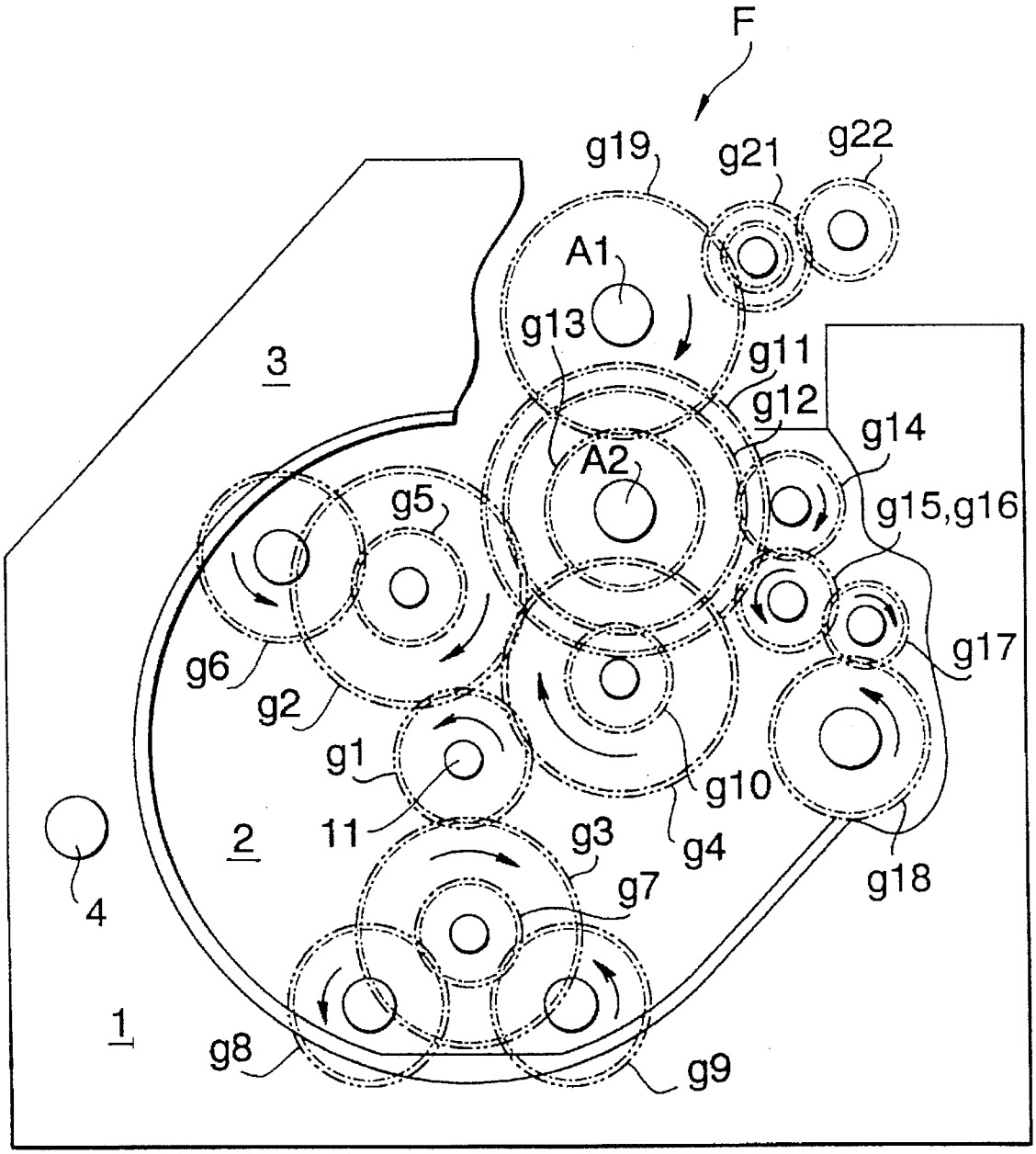
FIG. 9 shows a plurality of gears in the sheet feeding device.

As illustrated in FIG. 11, a drive source (i.e., motor) 231 is provided inside the sheet guide member 2. As illustrated in FIGS. 1 to 3, drive shafts 11 project outward from opposite lateral plates of the sheet guide 2 (only one shaft 11 is illustrated). Rotary power from the motor 231 is transmitted to the rollers via gears shown in FIG. 9. In FIG. 9, a drive shaft 11 rotates counterclockwise, a gear g1 is mounted on the drive shaft 11 and gears g2, g3 and g4 surround the gear g1 and mesh with the gear g1 respectively.

The gear g2 is positioned above the gear g1. Behind the gear g2, a gear g5 is integrally provided on the same shaft. The gear g5 engages with a gear g6 in its left. The gear g3 is positioned below the gear g1. Behind the gear g3, a gear g7 is integrally provided on a mutual shaft. The gear g7 engages with gears g8 and g9.

The gear g4 is located right of the gear g1, and gears g10 to g19 are connected with the gear g4 to form a gear train. As illustrated inn FIG. 10A, the gear g10 is located behind the gear g4 on the same shaft and engages with a gear g12 above itself. Behind the gear g12, provided on the same shaft A2 is a gear g13. The gear g13 engages with the gear g19 above itself.

The gear g12 meshes with the gear g14 in its right, and the gear g14 meshes with the gear g15 therebelow. In front of the gear g15, provided on the same shaft is the gear g16. The gear g16 meshes with the gear g11 located in front of the gear g12. Although the gears g12 and g18 are directly but rotatably mounted on the same shaft A2, the gear g11 is provided on the shaft A2 via a torque limiter t1 so that the rotary power is transmitted to the shaft A2 via the torque limiter. The gears g12 and g13 are free to rotate relative to the shaft A2. These gears, however, rotate together. Referring to FIG. 9, the gear g15 meshes with the gear g17 in its right and the gear g17 meshes with the gear g18 below Itself.

Referring back to FIG. 10A, the gear g11 is connected with the shaft A2 via the torque limiter t1. As illustrated in FIG. 10B, the torque limiter t1 includes a friction plate 18, a presser plate 17 which sandwiches the gear g11 with the friction plate 180 a spring 19 which forces the presser plate 17 against the gear g11 at its one end, a bearing portion 18*a* integral with the friction plate 18 and fixed on the shaft A2 for supporting the spring 19, and a flange 16 for supporting the spring 19 at the other end of the spring 19. The torque limiter t1 allows the rotary power of the gear g11 to be transmitted to the shaft A2 through a friction between the friction plate 18 and the gear g11. If a torque greater than the friction between the plate 18 and the gear g11 acts on the shaft A2, the gear g11 is disconnected from the shaft A2.

Referring to FIG. 9, when the gear g1 is rotated counterclockwise upon rotation of the drive shaft 11 of the motor 231, its rotation is transmitted to the gear g6 by way of the gears g2 and g5 so that the gear g6 rotates counterclockwise. At the same time, the rotary power is also transferred to the gears g8 and g9 via the gears g3 and g7 so that the gears g8 and g9 rotate counterclockwise respectively. Further, the rotary power is transferred to the gear g19 via the gears g4, g10, g12 and g13 so that the gear g19 rotates clockwise. Rotation of the gear g19 causes a shaft A1, which supports a separation roller Sr (will be described later), to rotate.

In addition, the rotation of the gear g1 is transmitted to the gear g11 via the gears g4, g10, g12, g14, g15 and g16 and consequently the gear g11 is rotated clockwise. Upon rotation of the gear g11, the shaft A2 which supports a retardation roller Rr (will be described later) is rotated via the torque limiter t1. Rotation of the gear g15 is transmitted to the gear g18 via the gear g17 so that the gear g18 is rotated counterclockwise. In this situation, the gears g6, g8, g9 and g18 rotate at the same speed (peripheral speed) which is faster than the gears g11 and g19 (gears g11 and g19 rotate at the same angular speed).

The rotations of the above-described gears cause the transfer rollers to rotate, which will be described below with reference to FIGS. 9 to 11. As illustrated in FIG. 11, a pick up roller Pr, a separation roller Sr, a retardation roller Rr, a pair of transfer rollers r1 and r2, reading rollers r3 and r4 and another pair of transfer rollers r5 and r6 are provided along the sheet passage in turn from the sheet entrance. The separation roller Sr and the retardation roller Rr are pressed against each other, the first pair of transfer rollers r1 and r2 are pressed to each other, the reading rollers r3 and r4 are biased onto the scanner glass 10, and the second pair of transfer rollers r5 and r6 are pressed to each other. The transfer rollers r1 and r5 are rotated counterclockwise or in a sheet feeding direction due to rotation of the gears g6 and g18 respectively (FIG. 9). The transfer rollers r2 and r6 are rotated by the transfer rollers r1 and r5 clockwise or in the sheet feeding direction respectively.

The reading rollers r3 and r4 are rotated by the gears g8 and g9 counterclockwise or in the sheet feeding direction (FIG. 9). As the gear g19 rotates, the shaft A1 rotates clockwise or in the sheet feeding direction. The rotation of the gear g11 causes the shaft A2 to rotate clockwise or in a direction opposite the sheet feeding direction. The retardation roller Rr is mounted on the shaft A2 (FIG. 11).

Figure 10A:
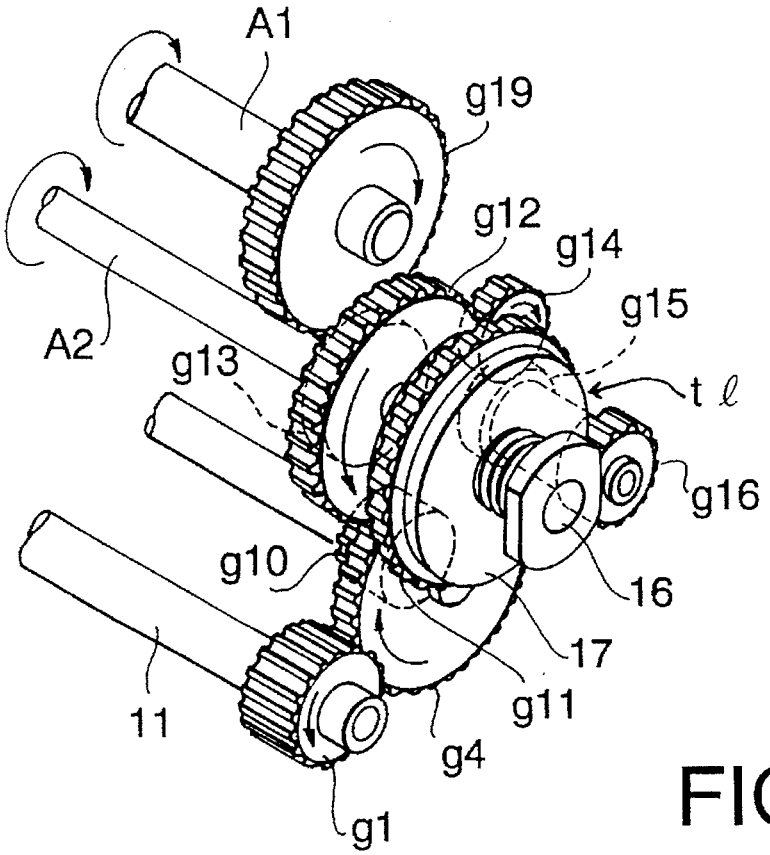
FIG. 10A is a perspective view showing the gears of FIG. 9 together with a torque limiter.
Figure 10B:
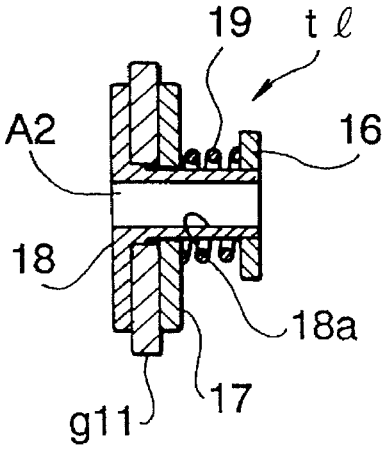
FIG. 10B is a sectional view of the torque limiter shown in FIG. 10A.

In the illustrated embodiment, the gear g11 and the shaft A2 are united by a friction force (FIGS. 10A and 10B). Therefore, if a torque greater than the friction force is applied to the retardation roller Rr or the shaft A2, the shaft A2 is disconnected from the gear g11. The pick up roller Pr receives rotary power from the shaft A1 via the gears and rotates clockwise (will be described later).

Since the reading rollers r3 and r4 are forced against the scanner glass 10, a sheet firmly contacts an upper surface of the scanner glass 10 when it is transferred on the scanner glass 10. Therefore, the sheet does not "flap" on the scanner glass 10 and accordingly a desired reading operation can be expected.

Figure 12:
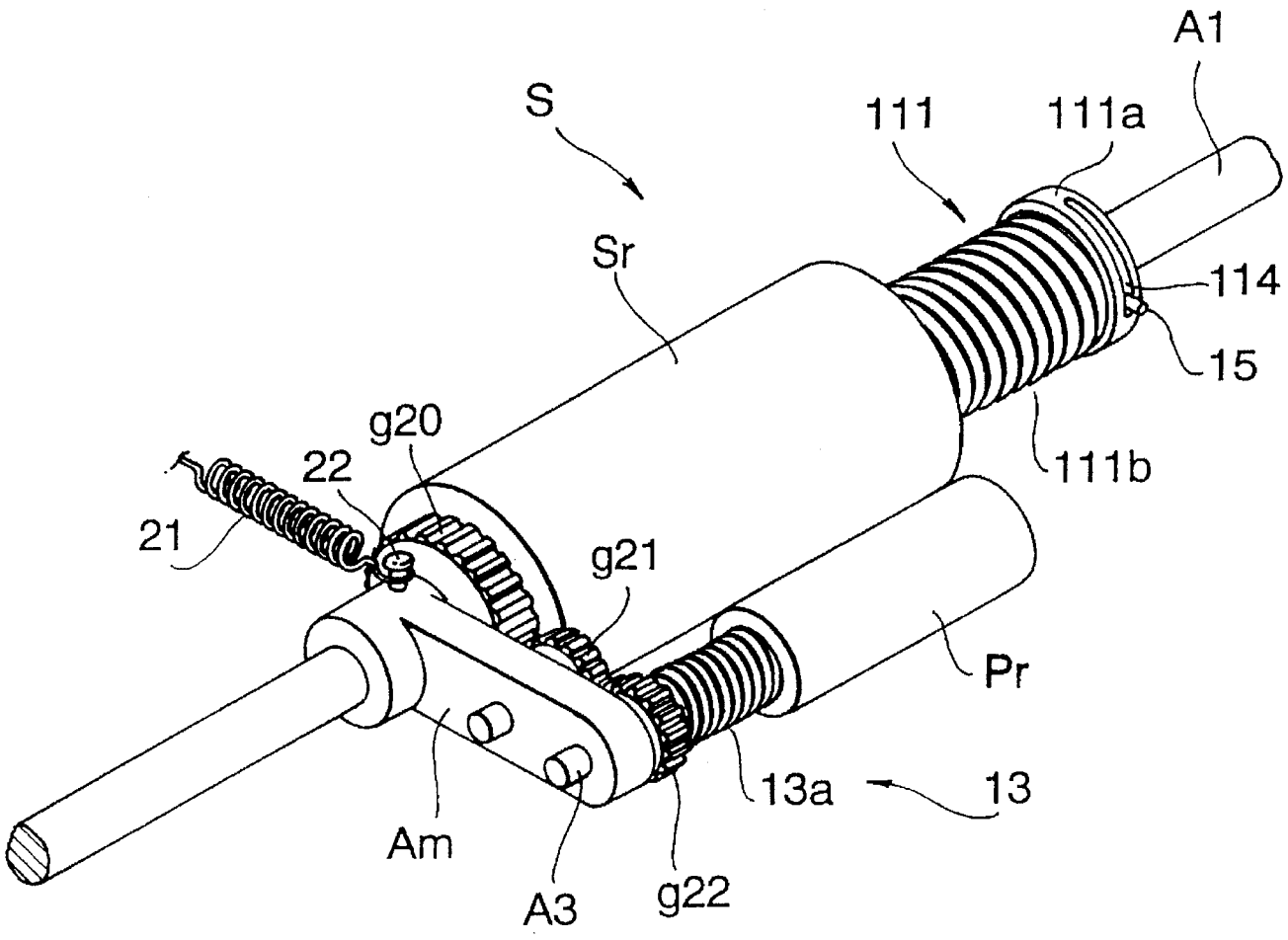
FIG. 12 illustrates a perspective view of a sheet separation mechanism of the sheet feeding device.
Figure 13:
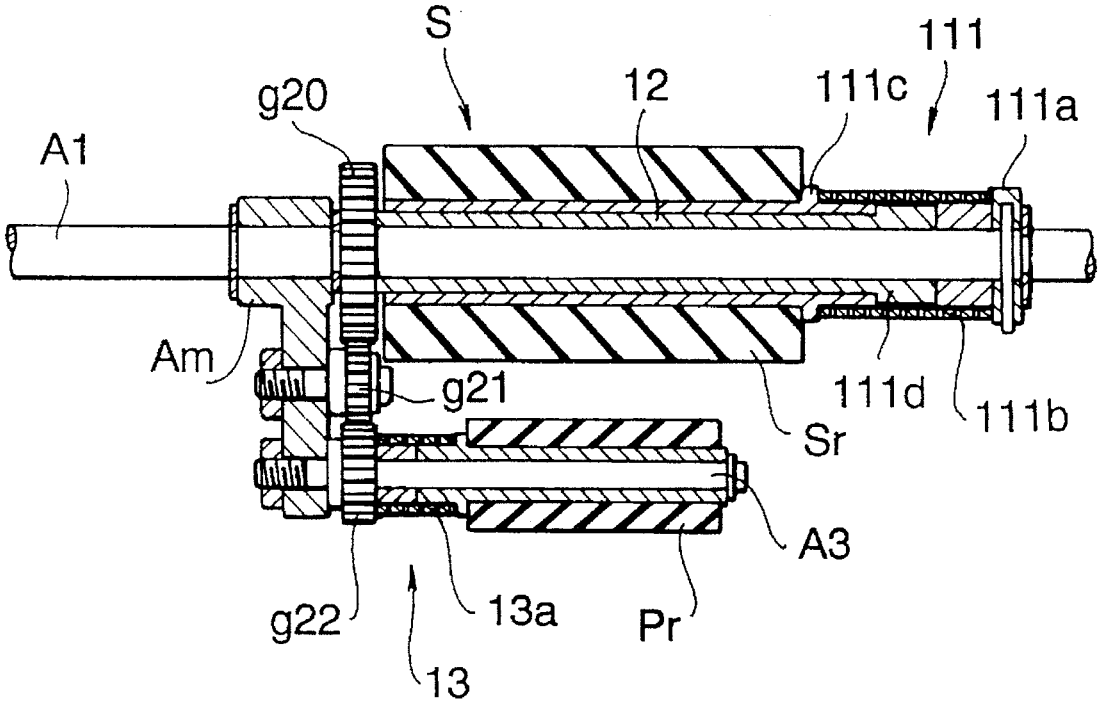
FIG. 13 is a sectional view of the sheet separation mechanism shown in FIG. 12.

A sheet separation unit S of the sheet feeding device F will be now described with reference to FIGS. 12 to 19. FIG. 12 illustrates a perspective view of major parts of the sheet separation unit S, FIG. 13 illustrates a sectional view of major parts of the sheet separation unit S, and FIGS. 14 to 19 illustrate schematic sectional views how one sheet is separated or picked up from a pile of sheets by the sheet separation unit S. As shown in FIGS. 12 and 13, the shaft A1 is provided with an arm Am and a gear g20 which are free to rotate relative to the shaft A1. The gear g20 has a cylindrical rotary member 12 (FIG. 13) fixed thereto.

The rotatable member 12 is fitted over the shaft A1 but free to rotate relative to the shaft A1. Likewise, the separation roller Sr loosely fits over the rotatable member 12 and is free to rotate relative to the rotatable member 12. Thus, the arm Am, the gear g20 and the separation roller Sr are all freely rotatable relative to the shaft A1. The arm Am is biased counterclockwise or upward by a spring 21 hooked on a pin 22 projected from the arm Am (FIG. 12). Accordingly, the arm Am does not take the position illustrated in FIG. 12 during a normal state. Rather, it is pulled counterclockwise and rests at a position far from the sheets or the sheet feeding tray.

Next to the separation roller Sr, provided on the shaft A1 is a spring clutch 111. Referring to FIG. 13, the spring clutch 111 includes a cylindrical clutch support 111*a* mounted on the shaft A1, a coil spring 111*b* fixed to the clutch support 111*a* at one end thereof, a separation roller support 111*c* integral with the separation roller Sr and a clutch portion 111*d* integral with the rotary member 12. The coil spring 111*b* is fixed to the separation roller support 111*c* at the other end. The clutch portion 111*d* is surrounded by the coil spring 11*b*.

As illustrated in FIG. 12, a slit-like opening 114 formed in the clutch support 111*a*. The opening 14 reaches the surface of the shaft A1. A projection 15 extending from the surface of the shaft A1 loosely fits in the opening 114. Therefore, the projection 15 is allowed to move from one end of the opening 15 to the other end of the same in the longitudinal direction of the opening 15 or in the peripheral direction of the shaft A1. The clutch support 11*a* can rotate relative to the shaft A1 within a range determined by the projection 15 and the opening 114.

The coil spring 111*b* is coiled in such a manner that its diameter becomes smaller as the clutch support 111*a* rotates in the sheet feeding direction and becomes larger as the separation roller Sr (or the separation roller support 11*c*) rotates in the sheet feeding direction. An outer diameter of the clutch portion 11*d* is smaller than an inner diameter of the coil spring 111*b* in a no loading state.

Therefore, if the shaft A1 rotates and in turn the clutch support member 111*a* rotates, the diameter of the coil spring 111*b* is reduced. Then, the coil spring 11*b* clinches the clutch portion 111*d* of the rotary member 12. As a result, the rotation of the shaft A1 is transmitted to the rotary member 12 and the gear g20 is rotated.

As mentioned earlier, the retardation roller Rr is positioned under the separation roller Sr, these rollers contact each other with a certain pressure, and the retardation roller Rr is provided on the shaft A2 via the torque limiter t1. When no sheets are fed to the contact between retardation roller Rr and the separation roller Sr, the rotation of the separation roller Sr generates a torque which acts on the retardation roller Rr. Therefore, the torque limiter t1 disconnects the shaft A2 from the gear g11. As a result, the retardation roller Rr is rotated by the separation roller Sr counterclockwise or in the sheet feeding direction.

The shaft A1 may be made from a flexible material. As illustrated in FIG. 2, the shaft A1 is biased downward by the leaf springs 20 fixed to the upper frame 8. The leaf springs 20 contact the shaft A1 at spring receiving elements 23 fixed to the shaft A1. As the downward biasing force acts on the shaft A1, the shaft A1 bends downward to a certain extent. Consequently, the separation roller Sr is forced against the retardation roller Rr. Pressurized connection between these two rollers is realized by such a simple structure.

As shown in FIG. 12, the arm Am is provided with gears g21 and g22 and these gears g21 and g22 transmit rotation of the gear g20 to the pick up roller Pr extending from a free end of the arm Am. A friction-causing-element or agent may be provided or applied between the gear g21 (or g22) and its shaft so that the gear will not rotate till a certain rotary power is given to the gear.

The gear g22 and the pick up roller Pr are rotatably provided on the same shaft A3 and a spring clutch 13 (more specifically, its coil spring 13*a*) connects the gear g22 with the pick up roller Pr. The coil spring 13*a* has a reduced diameter (or it shrinks) as the gear g22 rotates in the sheet feeding direction. As a result, the rotation of the gear g22 is transmitted to the pick up roller Pr. On the other hand, when the pick up roller Pr rotates in the sheet feeding direction, the coil spring 13*a* has an enlarged diameter and the gear g22 and the pick up roller Pr are disconnected.

Figure 14:
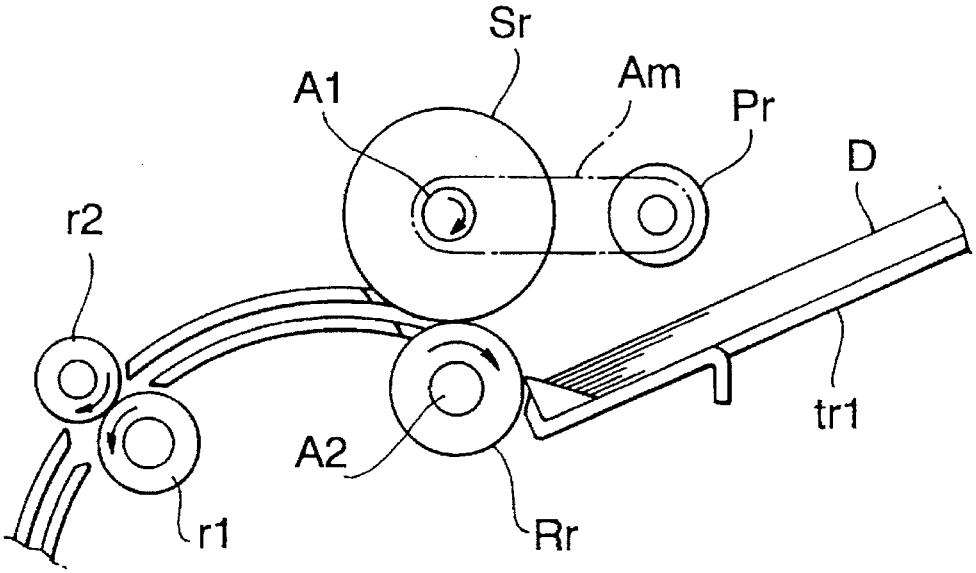
FIGS. 14 to 19 illustrate how one sheet is picked up or separated from a pile using the sheet separation mechanism shown in FIG. 12, respectively.

Referring now to FIGS. 12 and 14 to 19, sheet separation by the sheet separation unit S will be described. In FIG. 14, the sheets D are piled up on the sheet feeding tray tr1. The sheet separating operation is initiated so that the motor 231 is activated to cause the transfer rollers r1, r2, r5 and r6 and the reading rollers r3 and r4 to rotate in the sheet feeding direction, respectively. Simultaneously, the shaft A2 and the retardation roller Rr are caused to rotate in the direction opposite the sheet feeding direction. Also, the shaft A1 rotates clockwise and the clutch support 11*a* rotates clockwise.

At the very beginning of the sheet separation, the projection 15 of the shaft A1 (FIG. 12) contacts one end of the slit-like opening 114 of the clutch support 111*a* as illustrated in FIG. 12. This end of the opening 14 is the downstream end in the sheet feeding direction. As the clutch support 11*a* rotates clockwise or in the sheet feeding direction and the coil spring 111*b* has a reduced diameter, the coil spring 11*b* holds the clutch portion 111*d* of the rotary member 12. Consequently, the separation roller Sr and the gear g20 start rotating in the sheet feeding direction.

Figure 15:
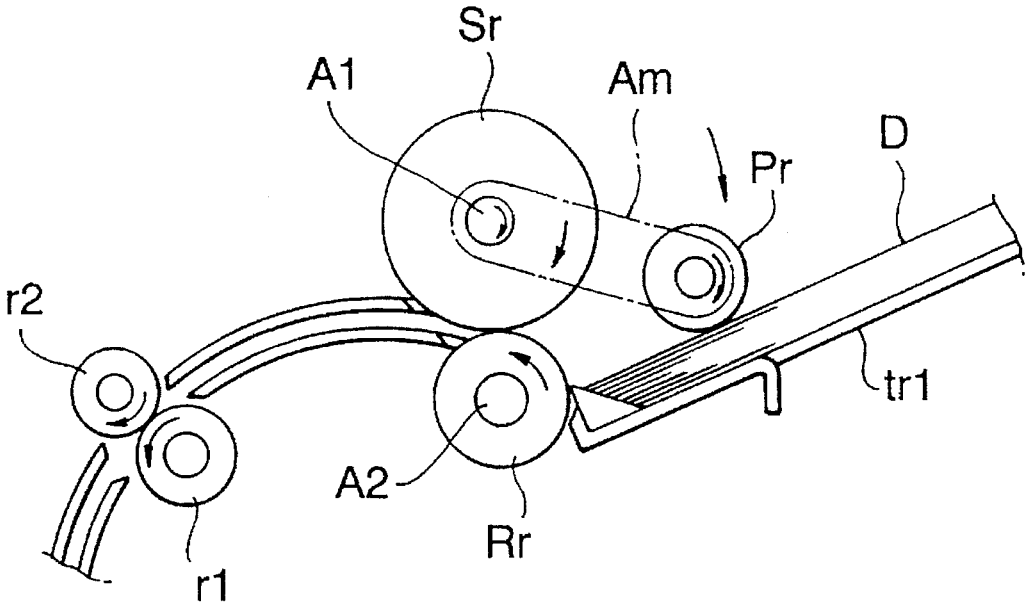

Referring to FIG. 15, as the separation toiler Sr rotates, the torque limiter t1 disconnects the shaft A2 from the gear g11 so that the retardation roller Rr is rotated by the separation roller Sr in the sheet feeding direction. When the gear g20 rotates, its rotation is transmitted to the gears g21 and g22. However, the gear g21 or g22 has a resistance or negative torque element (friction-causing-element) and the negative torque is set to be greater than an upward biasing force exerted by the spring 21 (FIG. 12). Therefore, the gears g21 and g22 do not rotate. Rather, the clockwise rotation is applied to the arm Am from the shaft A1 and the arm Am starts rotating clockwise or downward, as indicated by the arrow above the pick up roller Pr in FIG. 15.

Figure 16:
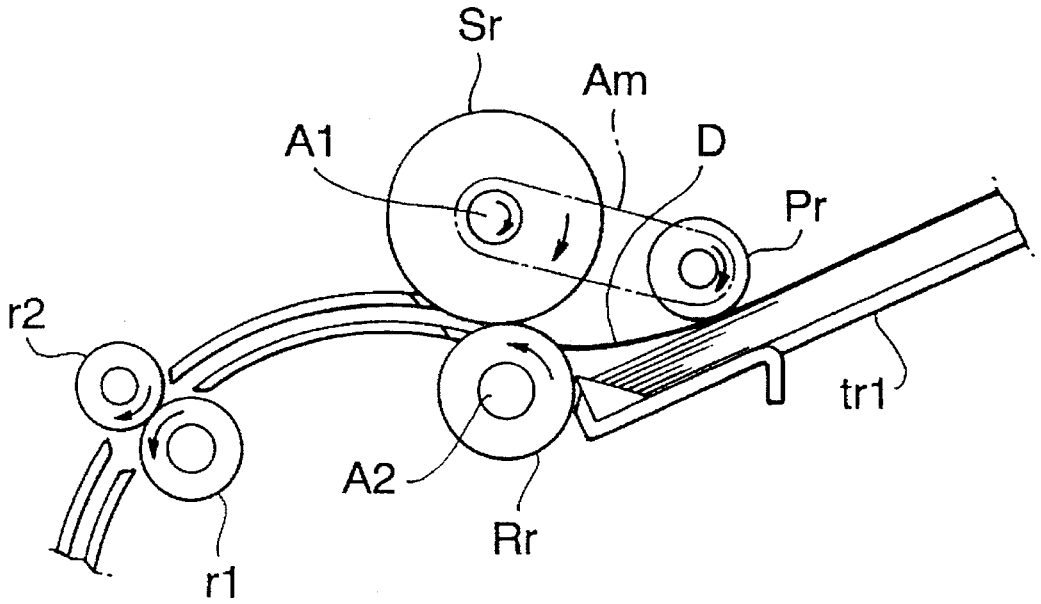

Referring to FIG. 16, the arm Am pivots downward and the pick up roller Pr reaches the top sheet D of the pile on the tray tr1. Then, the pivot movement of the arm Am is stopped. When the rotary power from the shaft A1 becomes greater than the negative torque at the gear g21 or g22, the gears g21 and g22 start rotating and the pick up roller Pr also starts rotating while the pick up roller Pr is being pressed against the sheet D. Rotation of the pick up roller Pr transmits the sheet D toward the separation roller Sr.

Figure 17:
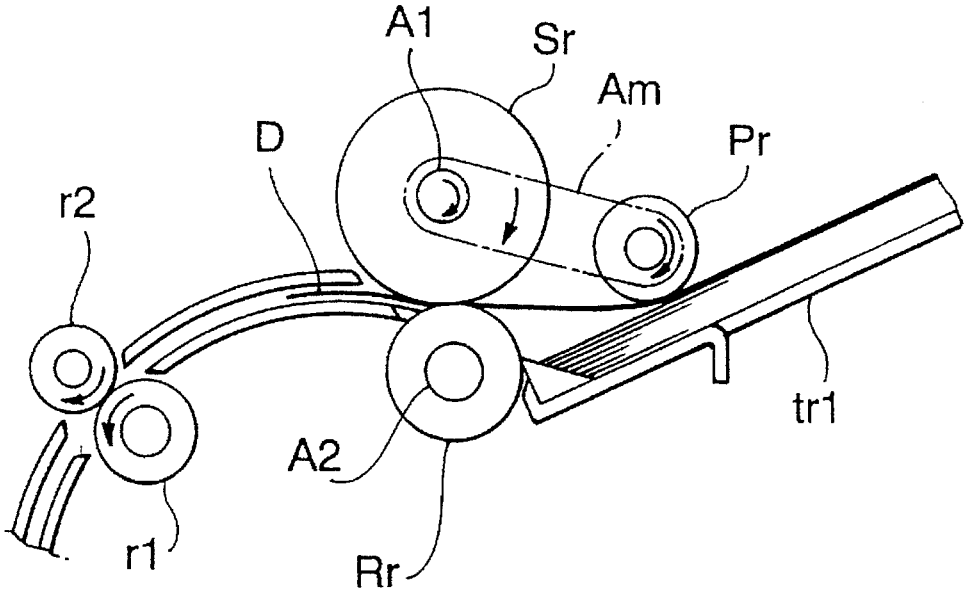

Next referring to FIG. 17, as the sheet D is squeezed into the contact between the separation roller Sr and the retardation roller Rr, the rotation of the separation roller Sr causes the sheet D to advance in the sheet feeding direction or downstream. At this situation, the retardation roller Rr is not given any torque from the separation roller Sr. However, rotary power of the gear g11 in the direction opposite the sheet feeding direction is applied to the retardation roller Rr via the torque limiter t1 (FIG. 10A) whereas friction between the retardation roller Rr and the sheet D moved by the separation roller Sr tends to rotate the retardation roller Rr in the sheet feeding direction. These two forces keep balance so that slippage occurs between the shaft A2 and the gear g11 and between the retardation roller Rr and the sheet D. In this case, the retardation roller Rr itself does not rotate.

Figure 18:
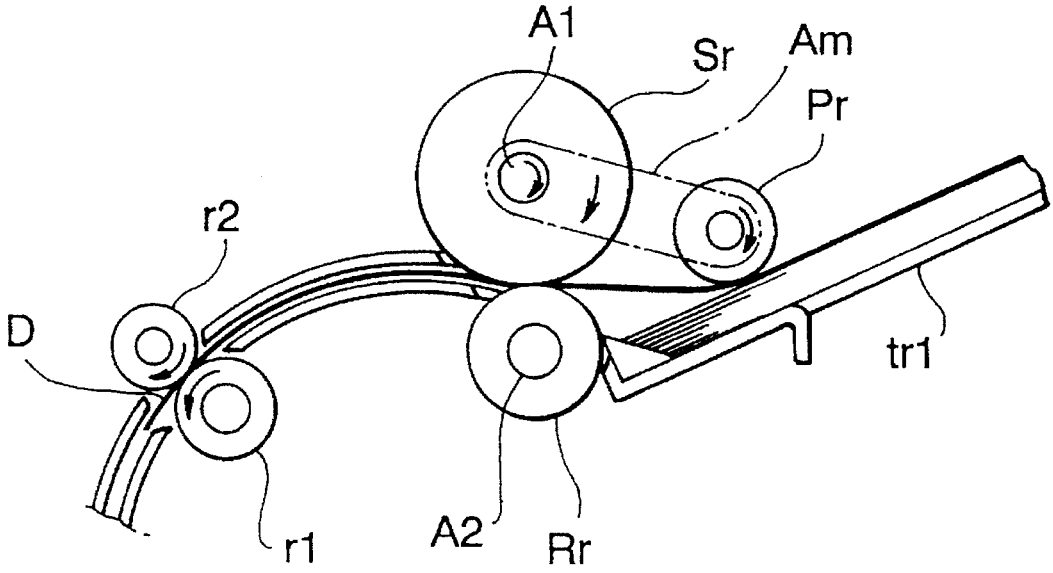

Referring to FIG. 18, the sheet D isolated from the pile by the pick up roller Pr, the separation roller Sr and the retardation roller Rr is transferred to the downstream transfer rollers r1 and r2. In this embodiment, the reading unit which operates with the sheet feeding device F of the present invention handles the image data one page by one page. Therefore, a relatively large distance is maintained between a rear end of the sheet D and a front end of a following sheet D' (FIG. 19) so that discontinuity between the successively transmitted sheets is made clear. For this end, the transfer rollers r1, r2, r5 and r6 and the reading rollers r3 and r4 rotate faster than the separation roller Sr.

Therefore, when the sheet D contacts the transfer rollers r1 and r2 as well as the separation roller Sr at the same time, the separation roller Sr is forced to rotate in the sheet feeding direction at the same speed (peripheral speed) as the transfer rollers r1 and r2 due to friction with the sheet D. In ocher words, the separation roller Sr rotates in the same direction as the shaft A1 but it rotates at a speed (peripheral speed) higher than the shaft A1. This results in an idle or lost motion of the separation roller Sr in the sheet feeding direction relative to the shaft A1.

As a result, the clutch support 111*a* rotates in the sheet feeding direction relative to the shaft A1 and the projection 15 of the shaft A1 moves in the elongated opening 114 of the clutch support 111*a* till it reaches the opposite end of the opening 114. Then, rotation of the separation roller Sr in the sheet feeding direction causes the coil spring 111*b* to radially expand. Thus, the coil spring 111*b* releases the clutch portion 111*d* of the rotary member 12.

Therefore, the arm Am is disconnected from the shaft A1 and swung upward due to the biasing force of the spring 21, and the pick up roller Pr leaves the sheet pile or the tray tr1. Moving the pick up roller Pr away from the tray tr1 results in smooth sheet feeding by the transfer rollers r1 and r2. If the pick up roller Pr stays on the sheet D, friction acts on the sheet D while the transfer rollers r1 and r2 intends to move or pull the sheet D.

Since the pick up roller Pr is connected with the gear g22 via the spring clutch 13 (FIG. 12), it rotates idly in the sheet feeding direction at the same speed (peripheral speed) as the transfer rollers r1 and r2 when the sheet D is sandwiched by the transfer rollers r1 and r2, which rotates relatively fast, till the arm Am moves up and the pick up roller Pr leaves the sheet.

Figure 19:
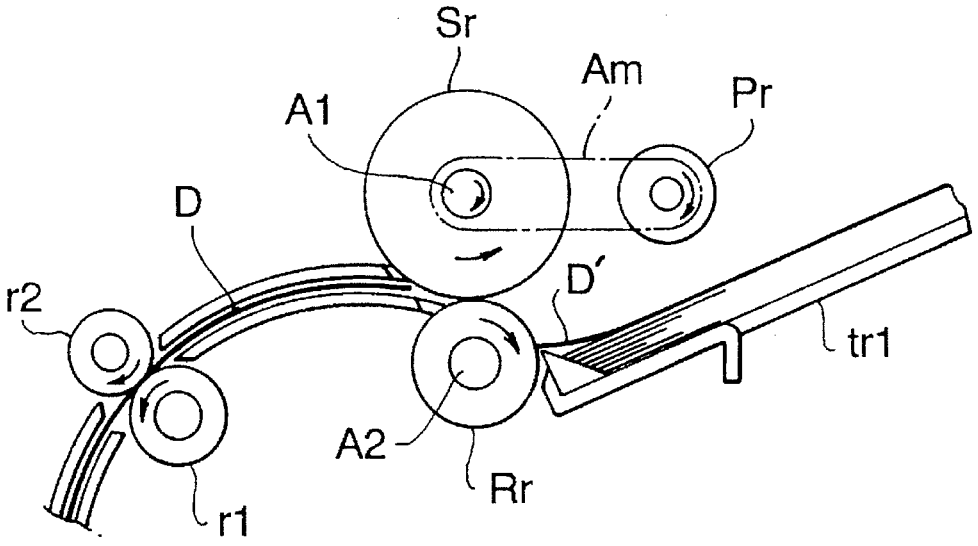
Figure 21:
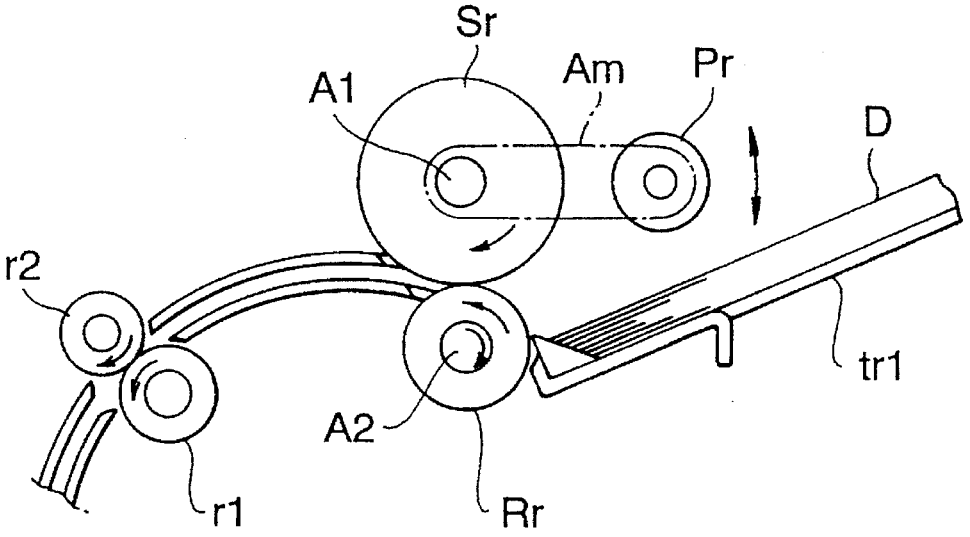
FIG. 21 PRIOR ART
FIG. 21 shows a sectional view of a conventional sheet feeding device.

Referring to FIG. 19, when the rear end of the sheet D passes through the separation roller Sr and the retardation roller Rr and the sheet D is further advanced toward the rollers r1 and r2, the separation roller Sr contacts the retardation roller Rr again (technically, these rollers are spaced from each other when the sheet D extends therebetween). In this situation, the separation roller Sr is forced to idly rotate in the sheet feeding direction, as mentioned above, and the coil spring 11*b* has an expanded diameter. Since the coil spring 11*b* loosely fits over the shaft A1 (FIG. 12), the rotation of the shaft A1 not transmitted to the separation roller St. This allows the separation roller Sr to rotate in the direction opposite the sheet feeding direction.

Therefore, the separation roller Sr is rotated by the retardation roller Rr which rotates in the direction opposite the sheet feeding direction (referred to "reverse direction"). This reverse rotation of the separation roller Sr prevents the following sheet D' from advancing in the sheet feeding direction when the preceding sheet D reaches the transfer rollers r1 and r2. Therefore, reliable one sheet by one sheet transmission is insured. Also, since a sufficient distance is maintained between the sheet D and the following sheet D', the reading unit which processes the image data one page by one page can function appropriately.

If the separation roller Sr is reversely rotated by the retardation roller Rr, then the diameter of the coil spring 11*b* becomes smaller, the clutch support 11*a* rotates in the reverse direction and the projection 15 of the shaft A1 moves in the elongated opening 14 and returns to the original position. Therefore, the rotation of the shaft A1 is transmitted to the separation roller Sr and the gear g20 again and repeat the above-described operation.

Figure 7:
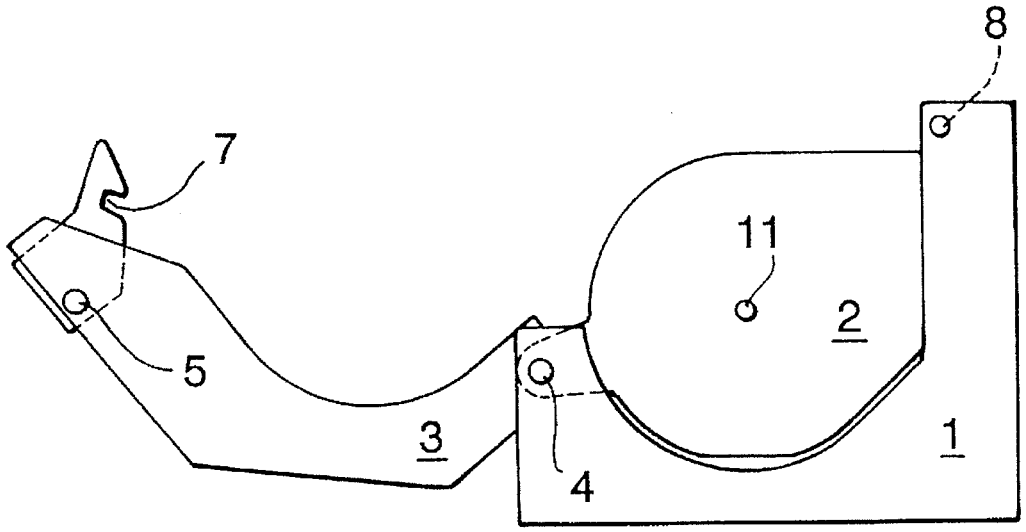
FIG. 7 illustrates a side view of the sheet feeding device when an upper frame is opened by a pivot movement.
Figure 8:
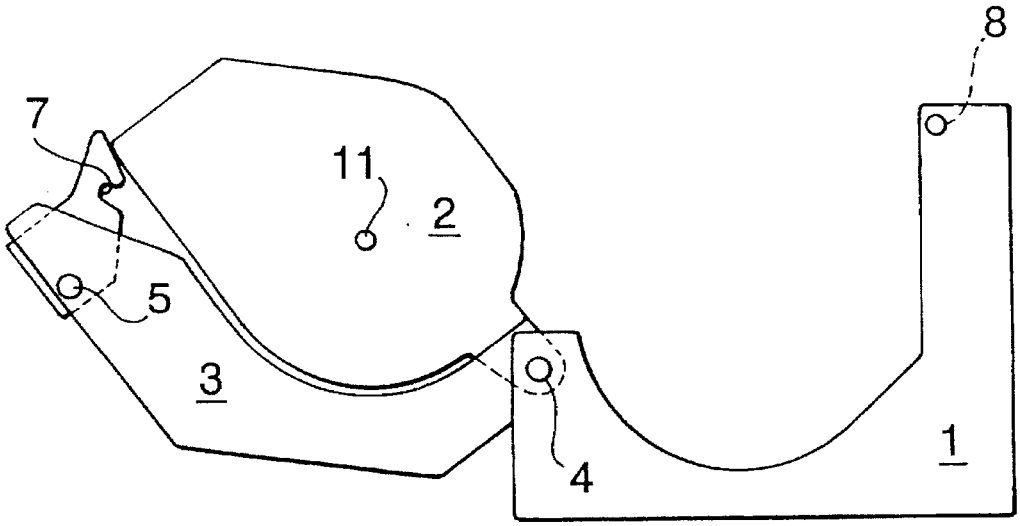
FIG. 8 is a view similar to FIG. 7 and illustrates a case where both the upper frame and the sheet guide portion are pivoted to their open positions.
Figure 22:
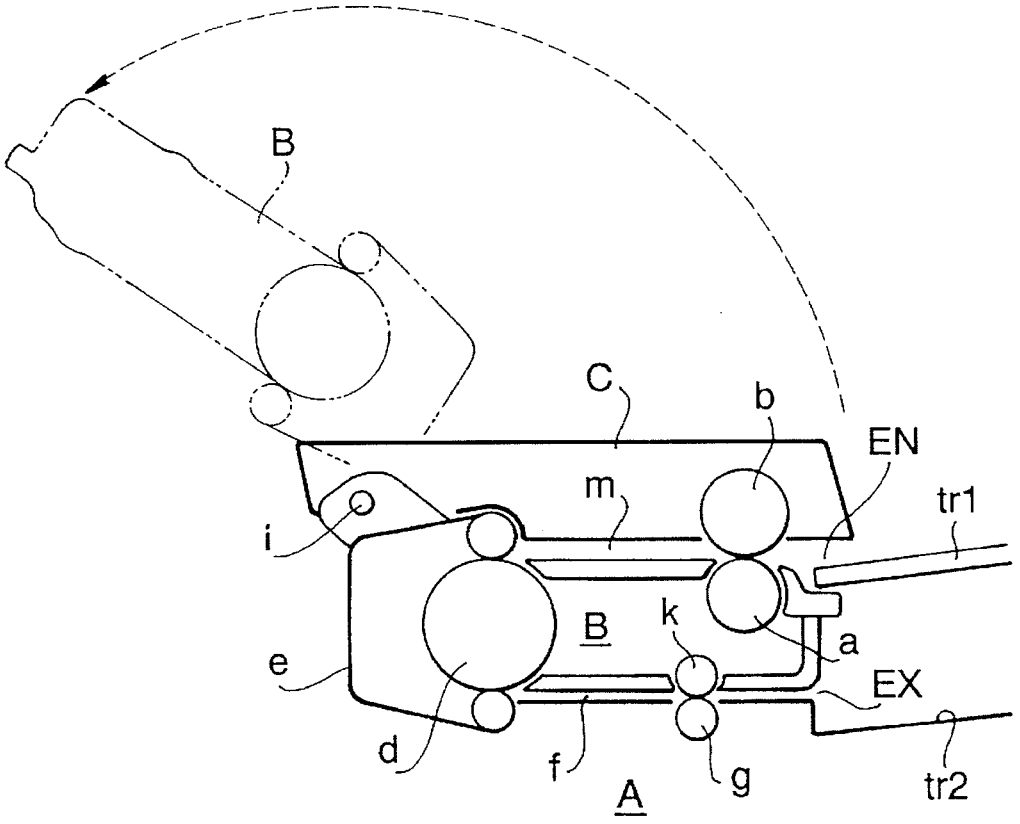
FIG. 22 PRIOR ART
FIG. 22 illustrates another conventional sheet feeding device.

The sheet feeding device of this embodiment can eliminate all the problems which prior art arrangements have. Specifically, since the guide member 2 has a generally circular section, not a shape extending in a width direction, it can have a reduced width as compared with a conventional arrangement (e.g., that illustrated in FIG. 22) if a length necessary for reading data on one sheet is constant. Therefore, when the upper frame 3 and the guide member 2 are opened as illustrated in FIGS. 7 and 8, they draw smaller arcs respectively as compared with the broken line arrow in FIG. 22. Further, if the guide member 2 has a circular section, it does not have to pivot in a large angle before it reaches a stable position as compared with a guide member having an elongated width. In addition, the guide member 2 and the upper frame 3 pivot about the same shaft 4 so that the guide member 2 is received in the upper frame as shown in FIG. 8 when they rest in their stable positions. This further saves the space.

Figure 20:
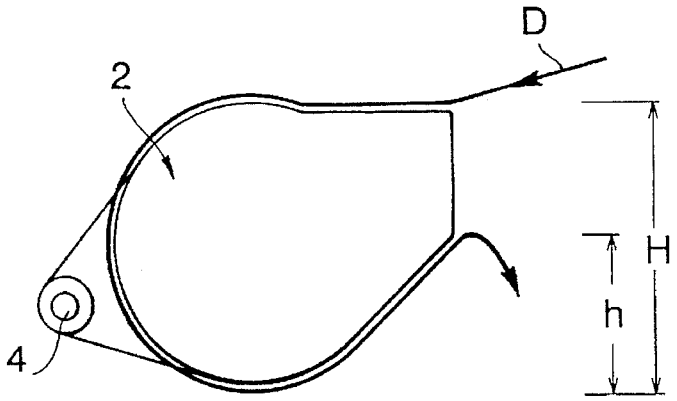
FIG. 20 depicts a schematic sectional view of the improved guide member of the present invention.

The circular section of the guide member 2 has still another advantage: the sheet entrance (sheet separation area S) and the sheet exit 14 can be formed close to each other without affecting other parts (FIGS. 11 and 20). Therefore, a relatively large step h can be formed within a height H of a scanner portion, as shown in FIG. 20. "h" represents a step from the sheet exit 14 from the sheet receiving tray tr2 (FIG. 11). This contributes to improvements in sheet discharging from the exit 14 and sheet receiving on the tray tr2.

A diameter of the guide member 2 may be enlarged to improve reading accuracy of the reading unit. A vacant space inside the guide member 2 may be used to house parts or the like or used for other purposes.

Figure 23:
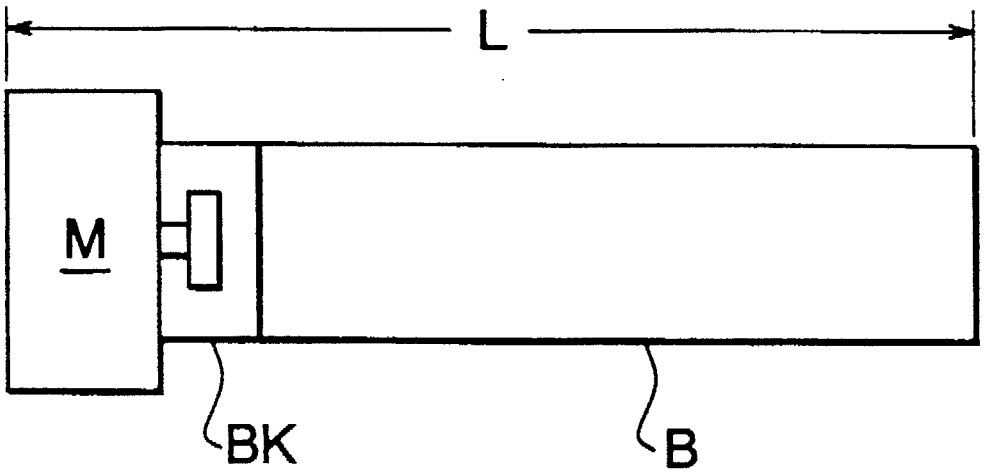
FIG. 23 PRIOR ART
FIG. 23 illustrates positional relation between a drive source (motor) and a guide member in a conventional arrangement shown in FIG. 22.

In the illustrated embodiment, the motor 231 is housed in the guide member 2 and a power transmission mechanism between the motor 231 and the rollers mounted on or in the guide member 2 is provided on a lateral surface of the guide member 2 in a compact manner. As compared with a conventional arrangement externally having a drive source (motor) on an end of the guide member (e.g., FIG. 23), a total width of the guide member 2 and the motor 231 ("L" in FIG. 23) is reduced. Further, electric parts such as a drive source and sensors and wirings are all housed in the guide member 2 so that the sheet feeding device can have a neat appearance and a designer is given a great freedom in determining positions of the parts.

The following modifications and/or changes may be made to the embodiment:

i) the clutch mechanism 111 may be dispensed with. Instead, the separation roller Sr and the rotary member 12 may be directly mounted on the shaft A1 and rotation of the shaft A1 may be transmitted to the pick up roller Pc via the rotary power transmission mechanism to which a negative torque is applied. In this case, the arm Am may be pivoted up and down upon normal and reverse rotations of the shaft A1. This may require a control unit or mechanism for the normal and reverse rotations of the shaft A1; and ii) the separation roller Sr and the rotary member 12 may rotate integrally or as a single unit, and a spring clutch may be provided between them and the shaft A1. If the clutch disconnects the separation roller and the rotary member from the shaft A1, the separation roller and the rotary member are rotated by the retardation roller Rr (i.e., rotational directions of the separation roller and the rotary member are reversed) so that the sheet D is fed backward and the arm Am is swung upward.

According to the present invention, the arm Am which shifts the pick up roller Pr up and down is not controlled by a solenoid, but a mechanical means. This simplifies an overall structure and reduces a cost. Further, when the rear end of the sheet D leaves the separation roller Sr, the separation roller Sr rotates in an opposite direction to prevent a next sheet D' from being transmitted immediately after the preceding sheet D. Therefore, accurate one-sheet-by-one-sheet feeding can be expected.

What is claimed is:

1. A sheet feeding device, comprising:

a rotary shaft rotatable in a sheet feeding direction;

a separation roller mounted on the rotary shaft;

a retardation roller in contact with the separation roller with a certain pressure;

an arm adapted to move vertically relative to the rotary shaft;

a pick up roller mounted on an end of the arm;

a rotary power transmission mechanism connected with the arm for transmitting rotary power from the rotary shaft to the pick up roller and moving the arm downward, a rotatable member for transmission of the rotary power to the rotary power transmission mechanism, the rotatable member and the separation roller being rotatable relative to the rotary shaft; and a coil spring fixed to the rotary shaft at one end thereof and to the separation roller at the other end, the coil spring being in spaced relationship with the rotatable member, having a diameter that is modifiable by rotation of the rotary shaft and being loosely fitted over the rotary shaft to form a spring clutch, wherein as the diameter of the coil spring becomes smaller upon rotation of the rotary shaft, the coil spring tightly engages the rotatable member to transmit the rotary power of the rotary shaft to the rotatable member, whereas as the separation roller performs an idle rotation relative to the rotary shaft, the diameter of the coil spring is enlarged and the engagement between the coil spring and the rotatable member is released, whereby the rotary power of the rotary shaft is not transmitted to the rotatable member.

2. The sheet feeding device of claim 1, further including a torque limiter, and wherein the retardation roller is connected with a drive source via the torque limiter and the drive source drives the retardation roller in a direction opposite the sheet feeding direction.

3. The sheet feeding device of claim 1, further including an elastic member for biasing the arm upward.

4. The sheet feeding device of claim 3, wherein the rotary power transmission mechanism is mounted on the arm and a torque generated by the the rotary power transmission mechanism is larger than a biasing force exerted by the elastic member.

* * * * *